US006306269B1

(12) United States Patent
Landrette

(10) Patent No.: US 6,306,269 B1
(45) Date of Patent: Oct. 23, 2001

(54) METHOD AND APPARATUS FOR EFFICIENTLY WET PLATING AND PROCESSING SMALL PARTS

(76) Inventor: Ronald Landrette, 59 Martin Rd., Bristol, CT (US) 06010

( * ) Notice: Subject to any disclaimer, the term of this patent is extended or adjusted under 35 U.S.C. 154(b) by 0 days.

(21) Appl. No.: 09/518,037

(22) Filed: Mar. 3, 2000

Related U.S. Application Data

(60) Provisional application No. 60/124,971, filed on Mar. 18, 1999.

(51) Int. Cl.[7] ..... C25B 9/00; C25C 7/00; C25D 17/00

(52) U.S. Cl. ..... 204/259

(58) Field of Search ..... 205/143; 204/259

(56) References Cited

U.S. PATENT DOCUMENTS 1,555,891 * 10/1925 Taylor ..... 205/143

4,162,951 * 7/1979 Tscherwitschke et al. ..... 204/213

* cited by examiner

*Primary Examiner*—Kathryn Gorgos
*Assistant Examiner*—Wesley A. Nicolas

(57) ABSTRACT

Apparatus for processing parts to be electroplated includes providing a processing fixture for supporting two open top rotating perforated baskets in a plating bath having an electrode in the bath external of the baskets, the baskets being rotatable about an axis of about sixty to sixty-five degrees with respect to the vertical, facilitating flow of plating solution to the parts and ease of loading and unloading the parts, while eliminating barrel doors. This arrangement furthermore enables a clear line of sight between the anode and the electroplated parts to enhance plating efficiency. The baskets may be readily transferred between plating, rinsing and drying stations without having the parts removed from the baskets, saving substantial labor costs.

20 Claims, 4 Drawing Sheets

METHOD AND APPARATUS FOR EFFICIENTLY WET PLATING AND PROCESSING SMALL PARTS

CROSS-REFERENCE TO RELATED APPLICATIONS

This application claims the benefit of provisional application serial No. 60/124,971, filed Mar. 18, 1999.

BACKGROUND OF THE INVENTION

This invention relates generally to the field of wet plating, and more specifically, processing apparatus for manipulating the parts being processed, typically by electroplating.

Small parts are often electroplated and are typically manually inserted and removed from each one of a number of processing stations in a production line, each station facilitates use of a mating fixture having an perforated horizontally oriented rotating barrel or basket for supporting and tumbling the parts being electroplated in the plating electrolyte, A particular layer is electroplated on the parts at certain processing stations, and stations are also provided for cleaning, rinsing, other processing, and drying the parts. Typically, the stations utilize perforated rotating barrels or baskets submerged and horizontally positioned in the electrolytic plating solution, such barrels having covers or doors for preventing the parts from falling out of the barrels. These doors have caused problems including part trappage and jamming, door warpage and door clamp replacement. The apertures in the barrel walls permit replenishment of the plating solution, but the perforated barrel walls still present detrimental mechanical impedance to solution flow. Also, the perforated barrel walls block a clear line of sight between the anode and cathode which further impedes maximum plating efficiencies. See for example U.S. Pat. No. 5,419,823 to Lazaro et al.; U.S. Pat. No. 4,162,951 to Tscherwitschke et al. While Clayton, U.S. Pat. No. 4,849,258 mentions prior art tilted open-ended barrels in col. 1, this is in connection with mechanical plating processes. Mechanical plating involves mechanical transfer of metal from one part to another that is not relevant to and outside the scope of the present invention, Further detrimental aspects of the aforesaid prior art electroplating apparatus can involve damage to the parts being plated due to insertion and removal of the parts to and from the barrels and wasted labor in performing these parts transfer steps. Typically, after wet processing, including rinsing, the parts are removed from the rotating barrels by being dumped into drying baskets to facilitate the drying of the parts before packing. Again, this handling of the parts increases labor costs and can result in further damage to the dumped parts.

SUMMARY OF PREFERRED EMBODIMENTS OF THE INVENTION

It is thus the principal object of the present invention to provide a more efficient, labor saving liquid plating portable processing fixture that can be employed within existing industry standard equipment, yet greatly reduce the disadvantages of the prior art method mentioned herein above. In accordance with the preferred embodiment of the invention, a novel fixture is supplied having a plurality of rotating cylindrical perforated baskets with their axes of rotation at an acute angle of twenty to seventy degrees from t he vertical; sixty to sixty-five degrees being most preferred. This angular orientation results in the elimination of the need for the cover or door for preventing the parts from falling out of the basket and all of the attendant previously described disadvantages of such a cover or door. Due to the resulting open top of the barrel, the flow of liquid plating solution is enhanced which decreases processing time. Also, manual insertion of the parts into the basket via the open top is made easier since the parts can't fall out, and no door or cover, required by prior art barrels, need be opened or closed; cleaning by spraying of the parts is also facilitated. The acute angle of the rotational barrel axis has the further advantage over the prior art of providing a clear line of site, through the open top of the baskets, between the anodes within the plating bath, external of the baskets, and the parts being plated, to additionally enhance plating efficiencies, in contrast with positioning the prior art perforated barrel wall in the line of sight.

Furthermore the novel basket fixture can be configured to be readily lifted out of one industry standard wet processing station and inserted into the next industry standard wet station and finally into the standard spin-drier station, for processing without removing the parts from one basket and re-inserting them into the basket of the adjacent station. Hence, labor costs are greatly reduced and the possibility of parts being damaged upon such transfer is minimized. No significant alteration of the industry standard station equipment is required using the fixture of the invention. The open top design of the baskets provide a venue for better rinsing of parts, thereby providing savings in water usage and waste treatment, also without requiring alterations to the existing processing machinery. Since plural baskets, typically two, are used in each fixture, which fixture can "travel" from one processing station to the next by transfer means such as a hoist, different parts may be processed at the same time, without co-mingling. The use of plural baskets in the same "travelling" fixture also results in the ability to process small to large lot sizes, on the same machinery, at the same time, allowing test runs to be ran side by side with production processing.

BRIEF DESCRIPTION OF THE DRAWINGS

The various features of the invention will become more apparent upon on study of the following detailed description, taken in conjunction with the drawings in which.

DETAILED DESCRIPTION OF PREFERRED EMBODIMENTS OF THE INVENTION

Figure 1:
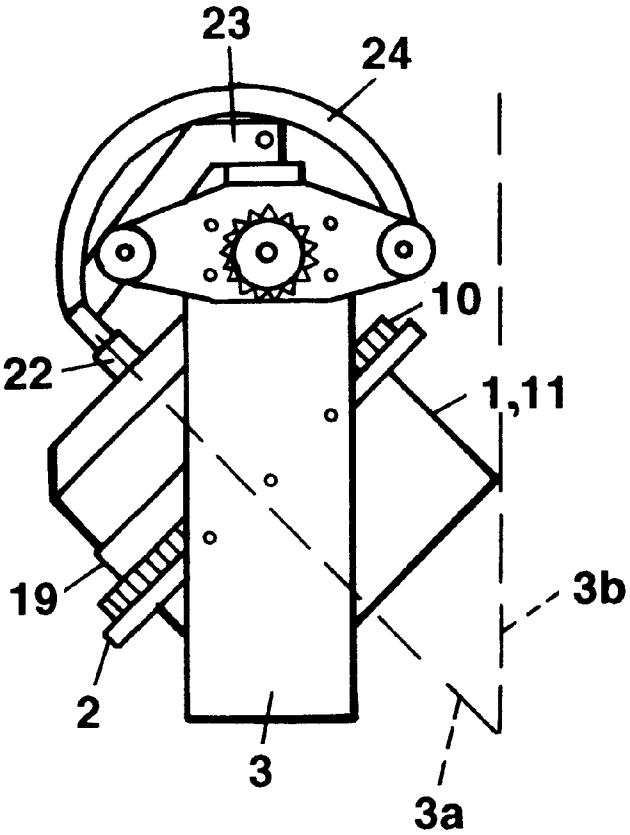
FIG. 1 is a side elevation view of the apparatus showing the preferred embodiment of the invention.

Referring now to the preferred embodiment shown in FIG. 1, twin baskets 1,11 are mounted in the aforesaid desired angular configuration supported by the mainframe 2 assembly which in turn is mounted to the mainframe supports 3. The mainframe supports 3 are mounted to the superstructure 4 for the purposes of supporting the entire assembly as is well known to those familiar with the art. The preferred embodiment of this invention shows a four point industry standard configuration superstructure 4; however its overall configuration is not critical to the invention, providing it is configured generally within industry standards and mates with all existing equipment.

The baskets 1,11 are rotated on their respective axis 3*a* making the aforesaid most preferred angle of sixty to sixty-five degrees with vertical line 3*b* of FIG. 1. Power provided to the primary basket 1 through its supporting gear 10, by the pinion gear 5, which is secured to a chemically inert shaft 6 supported on chemically inert bushings 7. This shaft receives its respective power from a bevel gear 8, which mates to secondary bevel gear 9, which is powered from the superstructure 4. The superstructure 4 drive train receives its power from a mating gear train, well known to those skilled in the art. For clarification, in the preferred embodiment, the primary basket 1 is driven by the pinion gear 5, the secondary basket 11 receives its motive power through the main support assembly by its mating support gear 10. The baskets 1,11 are constructed of perforated material and are of open top design, clearly shown in FIG. 2. The open top design allows for greatly enhanced solution flow, while the perforations 2*a* shown schematically by means of dots, provide additional solution transfer.

Figure 2:
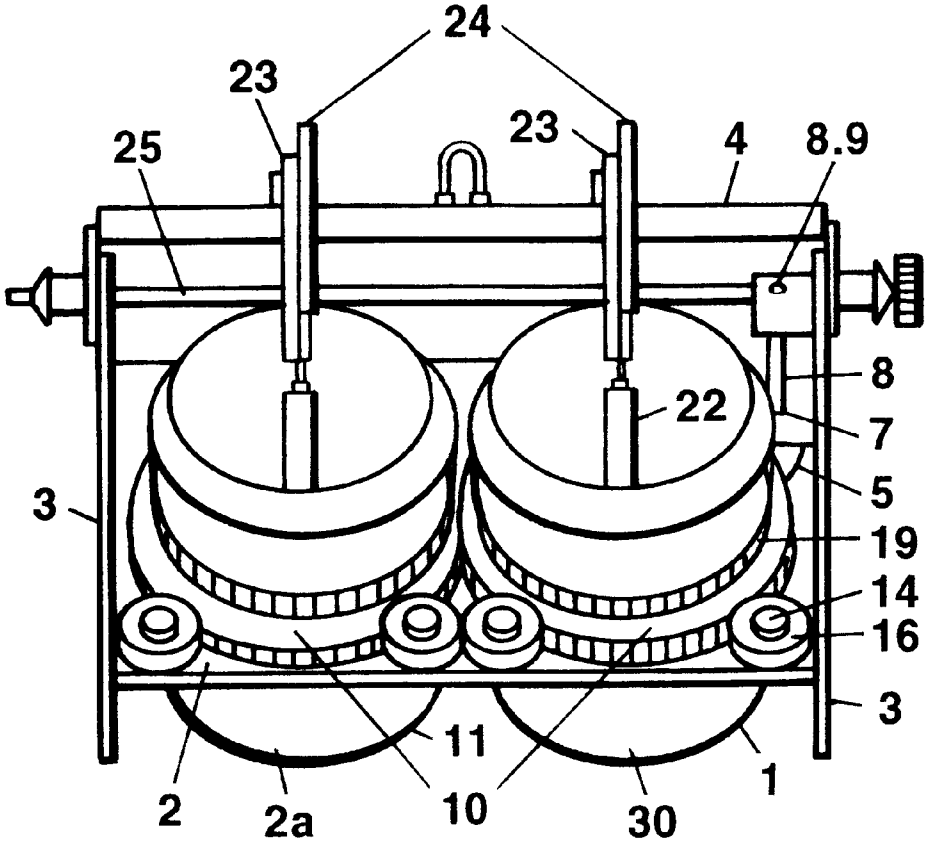
FIG. 2 is a front elevation of FIG. 1.

With reference to FIG. 1, it can be seen the parts held within the basket can be processed advantageously without requiring a cover to the basket. Those skilled in the art a very familiar with problems associated with doors, including part trappage and door warpage. Since no cover/door is required, door closure hardware common to this type of equipment clamps is eliminated. Further, by simple counterclockwise rotation of FIG. 1 on any given axis, parts can be dumped for automated processing, providing yet another distinct and definite advantage over existing technology. With reference to FIG. 2, it can be seen that a plurality of baskets 1,11 is utilized in this apparatus. This plurality of baskets 1,11 provides the advantage of co-processing of parts without intermingling of the parts.

Referring to FIGS. 1 and 2, the cathodic connection can be seen. It utilizes an item commonly known to those skilled in the art as a dangler 22, which is mounted to a non-conductive arm 23. The dangler is powered by a cable buss 24 in the preferred embodiment, but may use solid copper if required. The cable buss connects to the main buss 25, which is mounted to the superstructure 4. The non-conductive arms 23 allow the dangler 22, which provides the cathodic power and has a terminal portion positioned in the lowermost extreme bottom portion 30 of the basket, to be moved out of the basket 1,11 for basket changeover or removal. It should be noted here that not all processes that this apparatus will find use in connection with require cathodic power, and the cathodic assemblies may be eliminated for those processes that do not require it.

Figures 3, 4:
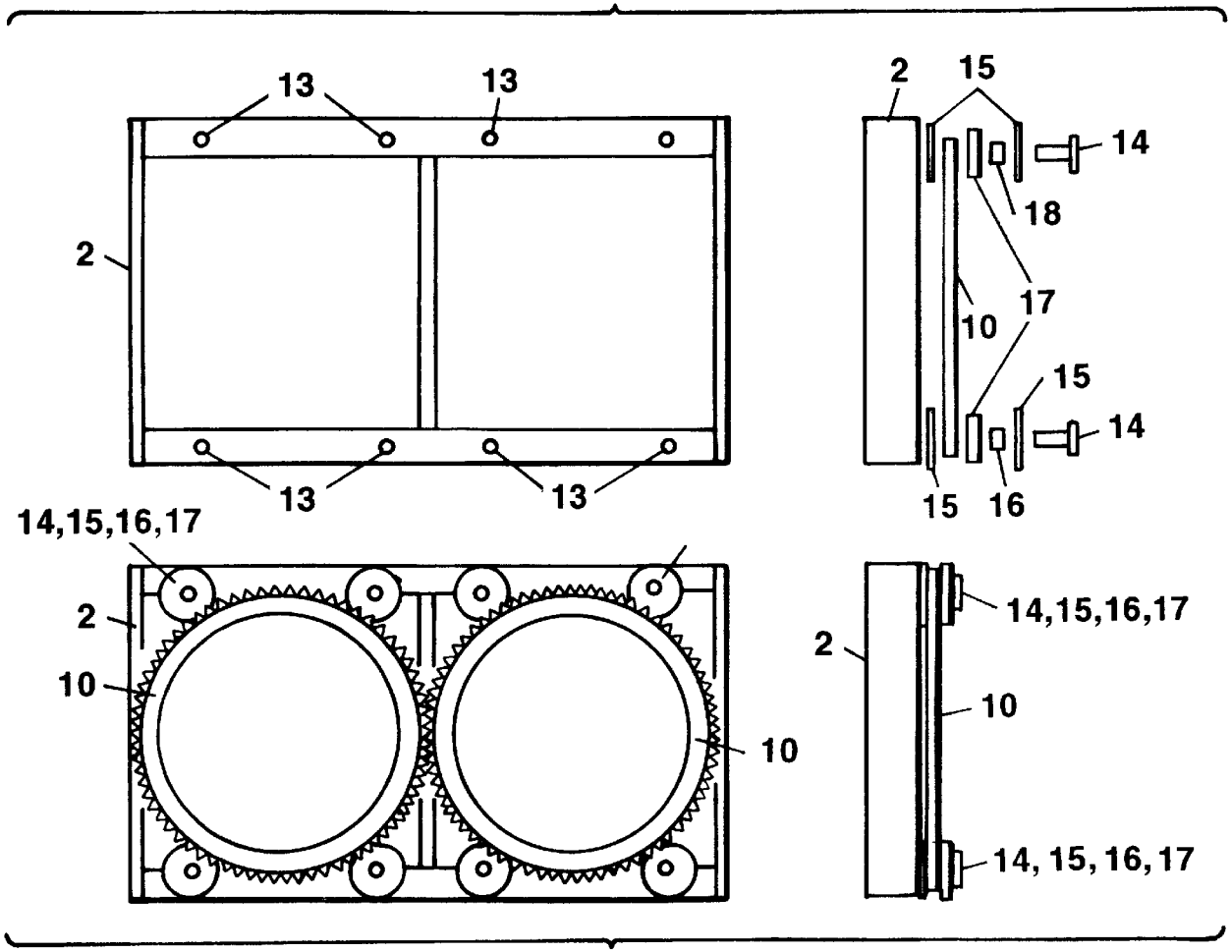
FIG. 3 is an enlarged view of the mainframe.
FIG. 4 is an assembled view of FIG. 3.

Referring to FIG. 3, the mainframe 12 can be seen as a top view and a side exploded view. The mainframe is fabricated of chemically inert materials. The holes 13 in the mainframe provide a mounting point for the bogey axles 14 which are manufactured from chemically inert materials, and retain two thrust washers 15, a wear bushing 16 that is also chemically inert material, and the bogey gear 17,which is also manufactured of chemically inert materials.

Figures 5, 6:
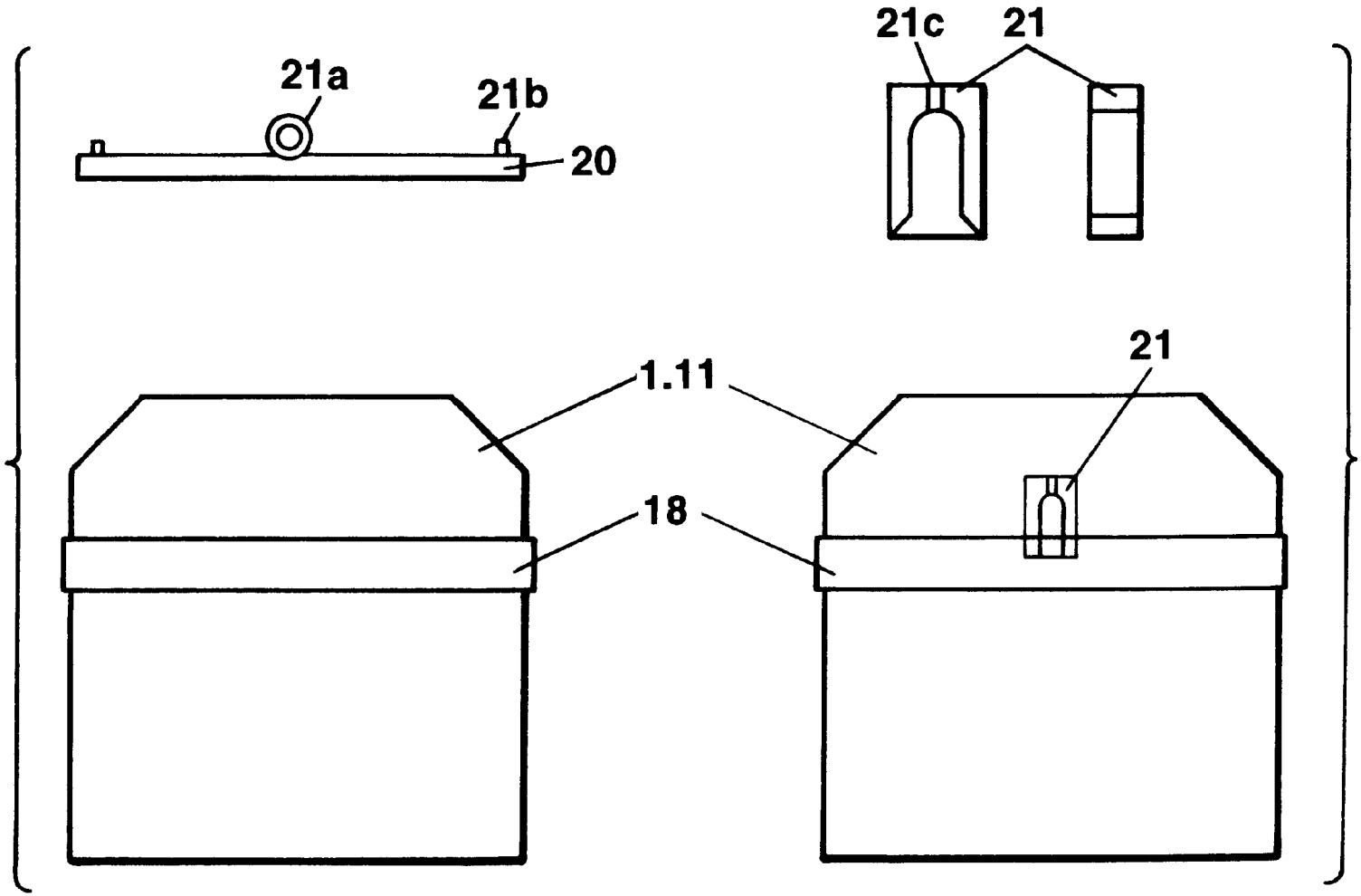
FIG. 5 is a front/side elevation of the baskets for the preferred embodiment of the invention.
FIG. 6 duplicates FIG. 5 and is provided for location reference.

FIG. 4 shows the bogey assemblies 18, which consist of items 14–17 above, as a group support and retain the support gears 10. Notably, one of the locations shown is the pinion gear 5, which is also equipped with thrust washers 15, although not shown for clarity. Referring to FIG. 5, a side/front elevation is shown of a basket. The basket is fabricated from chemically inert materials, perforated to enhance solution flow. In the preferred embodiment of this invention, the baskets 1,11 are fabricated from polynodular/pronob which is a material texture specification used to enhance tumbling action, and to resist parts sticking due to solution retention. The terms polynodular and pronob are well known to those skilled in the art. Baskets with a non-textured material may also be used, if conducive to the parts being processed. The baskets 1,11 are supported by the basket support ring 19, which supports the basket on the support gears 10.

It should be noted that the baskets might be left removable for manual processing, whereby each individual basket can be removed for individual further processing/transfer via hoist, or secured with simple hardware for automated processing, whereby the entire basket support apparatus with baskets of FIGS., 1 and 2 are readily transferred by transfer means such as hoists, not shown, from one processing station bath to the next.

Other baskets of different sizes, shapes or perforation may be used on the apparatus, providing they are adequately supported by the basket support ledge portions of support gears 10. Smaller baskets may be used for on-line test processing of parts, providing an invaluable tool for lab technicians, and the same smaller basket application provides benefits for prototypes such as samples for customers. It can be readily seen that this apparatus provides the advantage of quick and easy utilizing of different baskets, allowing for optimization of the basket to the product to be processed, be it in size, shape or perforation or interior texture. Optimization of this type inherently provides energy and waste treatment savings, by allowing optimum processing of product while still utilizing the framework of the existing machinery, which mates to the superstructure 4 of the basket support apparatus of FIGS. 1 and 2. Referring to FIG. 6, and the top of FIG. 5, a lifting apparatus or basket transfer means for the baskets 1,11 is illustrated. The lifting apparatus consist of the lift bar 20 and the lift mounts 21,which are attached to the interior of the basket. Other transfer means for the baskets, which can facilitate manual transfer, such as fixed handles or removable handles may be employed as called for by optimizing the various parameters of the baskets, such as size and shape.

In the preferred embodiment of this invention, the baskets are sized to conform within industry standards for drying equipment. These industry standards are well known to those skilled in the art. Another distinct advantage of this apparatus is the baskets 1,11 utilized for wet electroplating processing, can be lifted from the assembly and utilized in existing drying equipment, by engaging the lift bar 20 into the lift mounts 21, then using external lifting equipment to lift the basket via the centerhole 21*a* on the lift bar 20. Other basket transfer means may be provided from the fixture to the drying station or the next processing station. Thus the baskets perform double duty and multiple steps such as parts loading and unloading, employed with existing technology are eliminated, with the described basket transfer means, providing better use of man-hours, while expediting process time.

The preferred embodiment of the apparatus of the invention includes one or more of these baskets, manufactured of chemically inert materials, and which are perforated in such a manner to allow for solution transfer without allowing the parts to escape through the perforations or lodge within the perforations. These baskets are round in the ideal embodiment of this invention, but may be constructed in a multi-sided configuration as well. Preferably, these baskets are of dimensions to conform to other peripheral equipment required for processing. The baskets are supported by the processing fixture, baskets may be rigid mounted to the processing fixture for processing when the entire fixture is transferred between processing stations, or manually removable when only the baskets are to be transferred between stations. The processing fixture, or basket support means, in its ideal embodiment consist of the superstructure, mainframe, mainframe supports, corresponding drive train components, and the electrical transfer system. The superstructure for this assembly is constructed to mate with existing or new equipment; its usual embodiment is a fabricated metal structure, consisting of a carrier beam, with lifting faculties, and an electrical contact system for mating with other equipment. A drive means is required to provide rotation power to the mainframe. The drive means may be a motor of some type, or a mating gear mechanism to existing equipment.

The superstructure as an assembly is common equipment to those familiar with the art, and incorporates existing technology. Its existence is a requirement for the balance of the components, its overall configuration is not critical with the exception that it is of appropriate size and physical durability for mounting of the balance of the components. The mainframe supports are constructed from chemically inert materials, and are attached to the superstructure. These supports are adequately sized for capacity of the overall processing fixture, providing a mounting point for the mainframe. The mainframe supports double as a floor support or stand when the unit is not in use. The driven side of the process fixture may utilize one or both of the mainframe supports as support for transitional rotation power assembly. Transitional rotation power assembly is the transfer of rotation power from the superstructure to the mainframe. The preferred embodiment of the invention utilizes an upper bevel gear assembly operating on chemically inert shafting and bearings driving a submerged pinion gear providing rotation power to the assembly. Belt drive, friction drive, or other methods known to those skilled in the art may otherwise apply transitional power. The mainframe is constructed of chemically inert materials, and is attached to the mainframe supports. In its ideal embodiment, the mainframe is constructed to support the lower rotation mechanism, which in turn supports the baskets.

Figure 7:
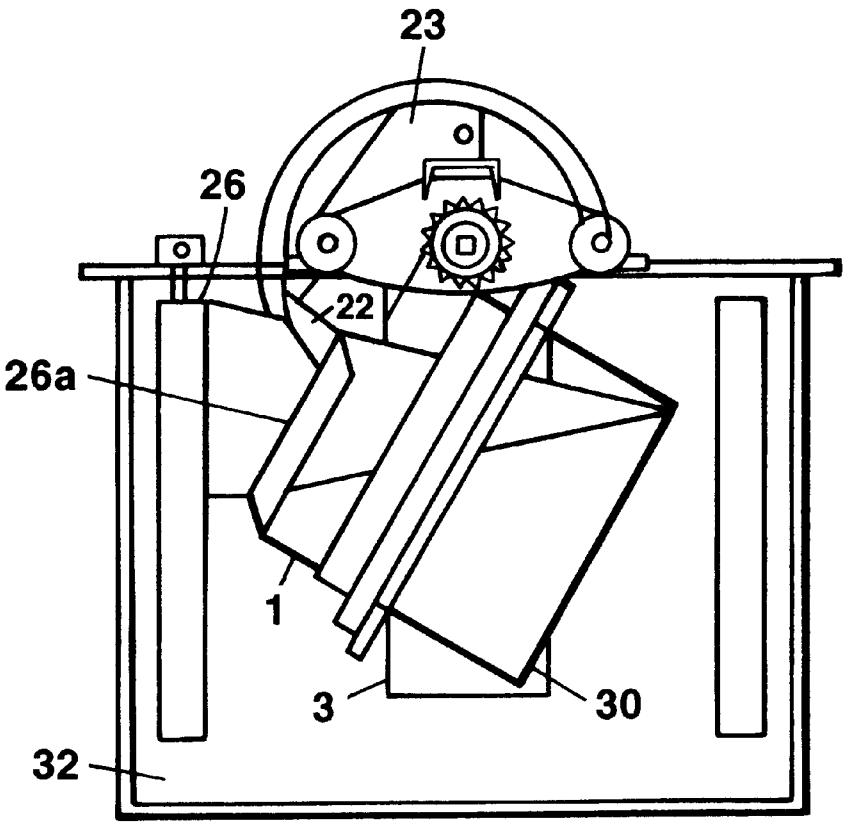
FIG. 7 illustrates the clear line of sight between the parts being electroplated within the baskets and a conventional anode basket filled with plating material within the bath.

The mainframe cylindrical basket rotational axis 3*a* is oriented at an acute angle, relative to the vertical plane 3*b* of the mainframe support as shown in FIG. 1. This angle for processing purposes is between twenty and seventy degrees in accordance with the invention, and is most preferably sixty to sixty-five degrees to accommodate the aforesaid clear line of sight, via the open barrel top, between the anode in the bath and the parts in the barrel being processed. As shown in FIG. 7, the anode 26, external of the barrel 1, is typically a porous body of titanium, filled with the plating metals. The tip of the aforesaid prior art dangler 22 is positioned at the lowermost portion 30 of the tipped cylindrical barrel 1 along with the parts being processed. The conventional porous anode body 26 is positioned vertically along the wall of the bath to provide the desired line of site 26*a* via the open barrel top. This important feature of the invention means that less amperage is needed relative to the aforesaid prior art closed substantially horizontal barrels in which the line of sight is only through perforated wall of the horizontal barrel. An additional bonus of employing the open top is that the flow of processing solution through the top is enhanced as mentioned previously, and viewing of the processed parts is additionally enhanced. Testing of samples also indicates that the resulting angular barrel rotation has a more gentle effect on the tumbled parts than is the case with the horizontal barrel. Changes to the angle of the mainframe can be readily achieved to meet any requirements simply by remounting the mainframe to the mainframe supports at varying angles and re-aligning the gear train.

As illustrated by FIG. 7, a portion of the second anode electrode 26 is positioned above a lower portion of the wide open top of the basket 1, which open top has a wide diameter substantially equal to the length of the basket. These two features of the preferred embodiment are in support of the aforesaid desired good line of sight.

The labor saving benefits of the invention are due to the elimination of loading and unloading the processed parts to and from the cylindrical baskets. The inventor posed the question: since the wet processing baskets and the prior art drying baskets are both perforated, why not use the prior art drying baskets for processing also, in order to eliminate the laborious transfer step from the wet processing barrels to the drying basket? The parts are plated within a plating station comprising the bath 32 containing the aforesaid fixture of FIGS. 1–4, and the tipped barrels shown in FIG. 7. In fact, the entire fixture of FIGS. 1 and 2 is present in the bath 32, and after the plating step is completed, the fixture, with its baskets, is thereafter transferred, for automatic processing, via a transfer means such as a hoist to a subsequent plating bath or baths, a rinsing bath and then to a drying station, typically a conventional spin drier, to complete the processing of the parts. Alternatively, if the cylindrical baskets are not fastened to the fixture and just rest against the basket support ledge portion of drive gear 10 via basket support ring 19, best shown in FIGS. 1 and 5, by virtue of gravity, the baskets can be readily lifted out of the fixture and manually inserted into the next fixture such as the aforesaid spin-drier station.

Since variations to the above will become readily apparent to those skilled in the art, the scope of the invention is to be restricted solely to the terms of the following claims and art recognized equivalents thereto. "Open top" means that the basket has a sufficient opening to permit substantially increased plating fluid flow and a good line of site from the parts in the basket to an anode in the bath external of the baskets, where such an anode is employed. It should be noted that not all stations and processes that the basket plater of the invention can be used for require electrochemical power, such as soak cleaning, rinsing, or solely chemical processing such as chromating, phosphating, black oxide or electroless nickel processing. These processes, well known to those skilled in the art, may be employed prior to, after, or separate from electroplating of the processed parts, but are understood to be generally within the planned use and scope of the invention. Thus, basket platers of the invention, built for these particular processes, do not utilize the cathode components of the above, as would be obvious to those skilled in the art. In the preferred embodiment, polypropylene is utilized as a chemically inert material. Polyethylene, or other plastics such as "Teflon" brand polymers may be used, while other operations may use stainless steel or other metals. The importance of chemically inert materials is to provide adequate life span while accounting for chemical interaction of the materials during processing. Knowledge of chemically inert materials in relation to their respective processes is well known to those skilled in the art. It also should be noted that in one embodiment of the invention, the mounting of the mainframe to the mainframe supports can pivot for unloading purposes. The mainframe is built to accept transitional rotation power, in the initial embodiment, this is the submerged pinion gear; other embodiments may utilize belt, friction or other drive means known to those skilled in the art. The transitional rotation power after application to the mainframe, provides rotation power to the basket assembly(s).

What is claimed is:

1. Apparatus for processing parts to be electroplated comprising:

(a) a processing fixture including support means for supporting at least one open top perforated basket having an open top for containing parts to be electroplated within a plating bath tank, along with a first electrode within said open top perforated basket in contact with said parts to be electroplated and a second electrode external of said open top perforated basket together with;

(b) drive means for rotating said open top perforated basket about a rotational axis having an acute angle with respect to a vertical plane, greater than 45 degrees and thus large enough for creating a clear line of sight through the open top of said basket and between said second electrode external of said basket and the parts being electroplated.

2. Apparatus of claim 1 wherein said acute angle with respect to said vertical plane is between 60 and 65 degrees.

3. Apparatus of claim 2 wherein at least a portion of said second electrode is positioned above a lower portion of said open top.

4. Apparatus of claim 2 wherein said open top has a diameter substantially equal to the length of said basket.

5. Apparatus of claim 2 wherein said support means includes a basket support ring surrounding said basket for supporting said basket within said support means, enabling easy lifting and removal of said basket by a hoist without the need for a fastening device.

6. Apparatus of claim 1 wherein at least a portion of said second electrode is positioned above a lower portion of said open top.

7. Apparatus of claim 1 wherein said open top has a diameter substantially equal to the length of said basket.

8. Apparatus of claim 1 wherein said support means includes a basket support ring surrounding said basket for supporting said basket within said support means, enabling easy lifting and removal of said basket by a hoist without the need for a fastening device.

9. Apparatus for processing parts to be electroplated comprising:

(a) a processing fixture including support means for supporting at last one open top perforated basket having an open top for containing parts to be electroplated within a plating bath tank, along with a first electrode positioned within said open top perforated basket and a second electrode external of said open top perforated basket together with;

(b) drive means for rotating said open top perforated basket about a rotational axis having an acute angle greater than 45 degrees with respect to a vertical plane; and (c) wherein at least a portion of said second electrode is positioned above a lower portion of said open top.

10. Apparatus of claim 9 wherein said open top has a diameter substantially equal to the length of said basket.

11. Apparatus of claim 10 wherein said support means includes a basket support ring surrounding said basket for supporting said basket within said support means, enabling easy lifting and removal of said basket by a hoist without the need for a fastening device.

12. Apparatus of claim 10 wherein said acute angle is between 60 and 65 degrees.

13. Apparatus of claim 11 wherein said support means includes a basket support ring surrounding said basket for supporting said basket within said support means, enabling easy lifting and removal of said basket by a hoist without the need for a fastening device.

14. Apparatus of claim 11 wherein said acute angle is between 60 and 65 degrees.

15. Apparatus of claim 13 wherein said acute angle is between 60 and 65 degrees.

16. Apparatus of claim 9 wherein said acute angle is between 60 and 65 degrees.

17. Apparatus for processing parts to be electroplated comprising:

(a) a processing fixture having basket support ledge portions surrounding side portions of at least one open top perforated basket for enabling supporting and removing of said open top perforated basket within a plating bath tank without a fastening device and;

(b) wherein said open top perforated basket contains parts to be electroplated within said plating bath tank, along with a first electrode within said open top perforated basket in contact with said parts to be electroplated and a second electrode external of said open top perforated basket together with;

(c) drive means for rotating said open top perforated basket about a rotational axis.

18. Apparatus of claim 17 wherein said rotational axis forms an acute angle with respect to a vertical plane, large enough for creating a clear line of sight through the open top of said perforated basket and between said second electrode external of said perforated basket and the parts being electroplated.

19. Apparatus of claim 18 wherein said acute angle is greater than 45 degrees.

20. Apparatus of claim 19 wherein said acute angle is between 60 and 65 degrees.

* * * * *